United States Patent [19]

Hirano et al.

[11] 4,234,448

[45] Nov. 18, 1980

[54] METHOD AND APPARATUS FOR TREATING RADIOACTIVE WASTE

[75] Inventors: Mikio Hirano; Susumu Horiuchi, both of Hitachi, Japan

[73] Assignee: Hitachi, Ltd., Japan

[21] Appl. No.: 846,251

[22] Filed: Oct. 27, 1977

[30] Foreign Application Priority Data

Nov. 1, 1976 [JP] Japan ..... 51-130527

[51] Int. Cl.[2] ..... G21F 9/08; G21F 9/20

[52] U.S. Cl. ..... 252/301.1 W; 34/11; 34/85; 34/102; 159/DIG. 12; 422/159; 422/903

[58] Field of Search ..... 252/301.1 W; 34/102, 34/11, 85; 423/553; 159/DIG. 12, DIG. 13, 6 R, 6 W; 165/95; 425/222, 225; 422/159, 903

[56] References Cited

U.S. PATENT DOCUMENTS

| | | | |
|---|---|---|---|
| 2,374,004 | 4/1945 | Ebert | 423/553 |
| 3,169,109 | 2/1965 | Hirs | 165/95 |
| 3,249,551 | 5/1966 | Bixby | 252/301.1 W |
| 3,679,595 | 7/1972 | Dollgast | 252/301.1 W |
| 4,033,868 | 7/1977 | Meichsner et al. | 252/301.1 W |

FOREIGN PATENT DOCUMENTS

| | | |
|---|---|---|
| 50-64699 | 5/1975 | Japan . |
| 50-64700 | 5/1975 | Japan . |

*Primary Examiner*—Benjamin R. Padgett
*Assistant Examiner*—Deborah L. Kyle
*Attorney, Agent, or Firm*—Craig & Antonelli

[57] ABSTRACT

In treatment of aqueous solutions and suspensions of radioactive waste through a step of drying and pulverizing the aqueous solutions and suspensions and a successive step of compressing and solidifying the resulting powders of radioactive waste, a step of measuring a water content of the powders is provided between the step of drying and pulverizing and the step of compressing and solidifying. When the measured water content of the powders fails to satisfy a predetermined water content, the powders are eliminated from a system of the treatment without passing through the step of compressing and solidifying.

16 Claims, 2 Drawing Figures

METHOD AND APPARATUS FOR TREATING RADIOACTIVE WASTE

List of Prior Art References (37 CFR 1.56 (a))

The following references are cited to show the state of the art:

Japanese Laid-Open Patent Application Specification No. 64699/75

U.S. Pat. No. 3,679,595

This invention relates to a method and apparatus for treating radioactive waste, and more particularly to a method and an apparatus for treating aqueous solutions and suspensions of radioactive waste through a step of drying and pulverizing the aqueous solutions and suspensions, and a successive step of compressing and solidifying the resulting powders of radioactive waste.

It is desirable to convert aqueous solutions and suspensions of radioactive waste discharged from atomic power stations into a chemically and physically stable solid state convenient for storage.

So far available methods for solidifying the aqueous solutions and suspensions of radioactive waste are based on cement solidification, asphalt solidification, etc. The cement solidification is carried out by mixing the aqueous solutions and suspensions of radioactive waste with cement to solidify the solutions and suspensions into a solid state, but has such a disadvantage as an increase in volume of solidified body, because usually the aqueous solutions and suspensions of radioactive waste are mixed, at a low concentration of the radioactive waste, with the cement. The asphalt solidification includes a step of placing the aqueous solutions and suspensions of radioactive waste into hot asphalt, which offers a danger of fire by the hot asphalt.

A method for treating the aqueous solutions and suspensions of radioactive waste by drying and solidification has been proposed to overcome the foregoing disadvantages encountered in the solidification treatment. That is, U.S. Pat. No. 3,679,595 discloses an art of solidification by adding a polyelectrolyte and bone glue to the aqueous solutions and suspensions or radioactive waste, heating and drying the resulting mixture on rollers, and compressing the rolled product.

The present invention provides a similar treatment of aqueous solutions and suspensions of radioactive waste by drying and pulverizing the aqueous solutions and suspensions of radioactive waste, and then compressing the resulting powders, thereby making solidified bodies of small volume.

A step of drying and pulverization of the aqueous solutions and suspensions of radioactive waste is carried out principally by a centrifugal film drier, and a step of compressing the resulting powders to make solidified bodies is carried out by a pelletizer. The pelletizer usually has two counter-disposed rollers, and powders are put into between the rollers by force, and compressed by revolution of the rollers to make solidified bodies. The rollers have recesses or indents on their surfaces and the solidified bodies are formed in the shapes of such recesses or indents. Usually, solidified bodies in a pellet state usually having sizes of a few centimeters are formed.

The solidified bodies in the pellet state are stored in drums, or, if necessary, filled with asphalt, etc., and thrown away into the ocean.

The treatment of the aqueous solutions and suspensions of radioactive waste by drying and solidification has a problem in obtaining good solidified bodies. That is, no good solidified bodies are obtained only by compressing the powders to make the solidified bodies, unless the powders having a water content below a definite limit content are employed. The limit content is called "limit water content", which is usually a few percents, but is determined on the basis of strength, etc. required for the solidified bodies.

The aqueous solutions and suspensions of radioactive waste are continuously fed to the drier, and powders are formed. The resulting powders have not always a constant water content, depending upon the properties of the aqueous solutions and suspensions of radioactive waste and operating conditions of the drier. Sometimes, powders having a water content for above the limit water content are formed. No good solidified bodies are obtained from such poor powders only by direct compression, and thus a further step is necessary to take the resulting powders having the undesired water content, from the drier.

The present invention provides a method and an apparatus which comprises measuring a water content of powders between a step of drying and pulverizing aqueous solutions and suspensions of radioactive waste and a step of compressing and solidifying the resulting powders, and eliminating the powders, when the measured water content of the powders is above a limit water content, from a system of the treatment by washing without passing through the step of compressing and solidifying.

An object of the present invention is to form good solidified bodies, that is, solidified bodies of high strength.

The present invention further provides a method which comprises eliminating the poor powders having a water content above the limit water content rapidly by washing with hot water at a temperature of not lower than 32° C. as a washing solution, when a main solid component of the radioactive waste is $Na_2SO_4$.

The present invention will be described in detail below, referring to the accompanying drawings.

Figure 2:
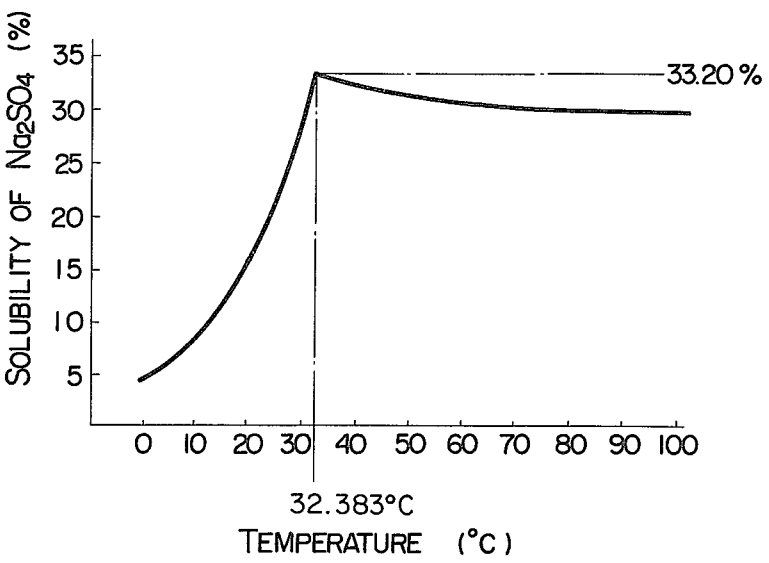
FIG. 2 is a diagram showing a solubility curve of sodium sulfate.

The present method for treating aqueous solutions and suspensions of radioactive waste comprises a step of drying and pulverizing aqueous solutions and suspensions of radioactive waste, a step of transferring powders formed in the step of drying and pulverizing to a hopper, a step of measuring a water content of the powders, and a step of pelletizing the powders, wherein a further step of introducing a washing solution into the hopper at the bottom when the measured water content of the powders fails to satisfy a predetermined condition, thereby dissolving the powders, and then discharging the washing solution is provided. The predetermined condition means a water content below the limit water content.

As a means for removing the powders from the hopper, an ordinary powder transportation means such as pneumatic transportation, etc. would be available, for example, in the case of dry powders, but is not applicable to powders of high water content. Thus, when the water content of powders is above the limit water content, a means of dissolution and washing is employed in the present invention. However, in that case, it is not suitable merely to introduce the washing solution to the hopper at the top and wash out the powders, because the washing solution cannot permeate into the powders. That is, dissolution of the powders can be readily carried out by introducing the washing solution to the hopper at the bottom, causing natural stirring in the hopper.

To realize the present method, the present invention provide an apparatus for treating aqueous solutions and suspensions of radioactive waste, which comprises a drier, a pelletizer provided at downstream of the drier, and a hopper and a water content-measuring device each provided in a conduit from the drier to the pelletizer, wherein an inlet for introducing a washing solution is provided at the bottom of the hopper. The term "the bottom of the hopper" means not only a bottom end of the hopper, but also a lower part near the bottom end, because sometimes the inlet for introducing the washing solution cannot be provided at the bottom end of the hopper owing to a design problem. The term "the bottom of the hopper" covers the bottom end and also part near the bottom end and means a region where a stirring action is attained by introducing the washing solution.

Furthermore, a gas pipe can be connected to the inlet for introducing the washing solution to the hopper at the same time to inject air, etc. to the hopper at the washing to intensify the stirring action, or to inject dry air, etc. after the washing to dry the system.

Further feature of the present invention relates to a treatment of a waste regenerating solution for desalters and resins, which takes most of the aqueous solutions and suspensions of radioactive waste generated in the atomic power stations. More than 80–90% of the powders formed by drying the waste regenerating solution for desalters and resins is comprised of sodium sulfate, $Na_2SO_4$. It is known as a physical property of sodium sulfate that sodium sulfate becomes very hard when deposited from its solution or when its powders are admixed with cold water.

As shown in FIG. 2, sodium sulfate has a maximum solubility 33% at about 32° C. The solubility is slightly decreased in a temperature range above 32° C., but considerably decreased at a temperature range below 32° C. It is also known that precipitates are formed above 32° C. take a form of $Na_2SO_4$, whereas those formed below 32° C. have water of crystallization in the form of $Na_2SO_4 \cdot 10H_2O$. For example, the present inventors found by experiments that, when two-fold volume (based on volume of $Na_2SO_4$ powders) of city water at about 15° C. was poured onto the $Na_2SO_4$ powders to dissolve the powders, very hard crystals were formed and dissolution of the powders was difficult to make, whereas, when the same volume of water at a temperature above 32° C., for example, hot water at 60° C., was poured onto the $Na_2SO_4$ powders, no crystals were formed, and the powders were converted to a slurry state.

That is, the present invention is further characterized by using water above 32° C., for example, hot water at 60° C. or higher, as the washing solution, when most of solid matters of the aqueous solutions and suspensions of radioactive waste is comprised of $Na_2SO_4$.

One embodiment of the present invention will be described referring to FIG. 1.

Figure 1:
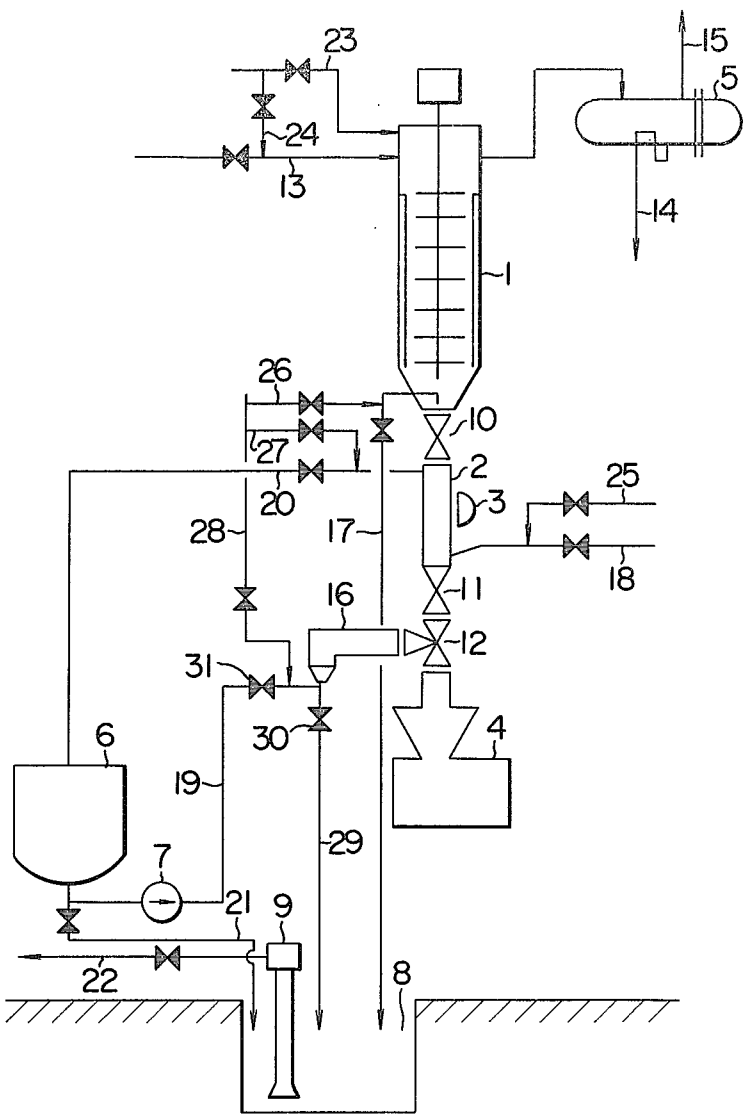
FIG. 1 is a schematic flow diagram showing one embodiment of the present invention.

As shown in FIG. 1, one embodiment of the present apparatus for treating aqueous solutions and suspensions of radioactive waste comprises a centrifugal film drier 1, a drier outlet valve 10, a hopper 2, a water content-measuring device 3 fixed to the hopper, a three-way switch valve 12, a pelletizer 4, washing pipings 18, 16, 19 open to the bottom of the hopper, washing solution-discharging pipings 17, 21, 29, drier-washing pipings 23, 24, a feed piping 13 for aqueous solutions and suspensions of radioactive waste, a washing tank 6, a pump 7, a washing sump 8, a sump pump 9, a sump pump piping 22, drying air pipings 25–28, a condenser 5, a negative pressure suction piping 15, and a condensate outlet piping 14.

Aqueous solutions and suspensions of radioactive waste are fed to centrifugal film drier 1 through feed piping 13, and pulverized. The resulting powders are retained once in hopper 2, and their water content is measured in a batch by water content-measuring device 3. In the present embodiment, the powders are led to pelletizer 4 through valves 11, 12, if their water content is less than 3% by weight, and pelletized. The resulting pellets are filled in drums (not shown in the drawing) and reserved in a storing place. If the water content of the powders is higher than 3% by weight, washing water is introduced to the hopper through an inlet (not shown in the drawing) provided at the bottom of the hopper through washing piping 18 under a pressure of 3–5 $kg/cm^2$ gage at a flow rate of 10–15 $m^3/hr$. When, for example, about 40 l of powders consisting mainly of $Na_2SO_4$ in the hopper is redissolved, the weight of the powders will be 36 kg, assuming that the density of the powders is 0.9 $g/cm^3$. Suppose hot water at 60° C. is used to dissolve the powders up to a concentration of 15% by weight, a volume of the resulting solution will be 240 l. In the present embodiment, washing water is introduced up to the inside of the drier through washing piping 18. The volume of the drier up to its top is about 500 l, and thus the dissolution can be satisfactorily carried out. To promote the dissolution and washing, it is desirable to introduce compressed air to the hopper through piping 25 and rotate the rotor of the centrifugal film drier at the same time. After the completion of dissolution and washing, hopper outlet valve 11 is opened. Three-way switch valve 12 is switched to be connected to washing piping 16, and valve 30 is opened. The solution flows down to washing sump 8.

The foregoing washing procedures can be conducted in combination or independently according to the following system.

Hot water is filled in washing tank 6, and introduced to hopper 2 at the bottom through three-way switch valve 12 by pump 7 to dissolve the powders. The resulting solution is returned to the washing tank through piping 20. Such recycling is carried out for a duration of 10–20 minutes to wash valves 12, 11, and hopper 2. After the completion of recycling operation, the washing solution is discharged to washing sump 8 through pipings 16 and 21. The washing solution is returned to a system inlet by sump pump 9 and retreated.

After the washing, drying is carried out with drying air. Drying air is injected through pipings 25, 26, 27, 28 to effect drying after the washing. The drying is carried out with drying air having a dew point of −10° to 30° C. at a flow rate of about 50 $Nm^3/hr$, and the drying is completed for a duration of about 20–30 minutes. Restarting of the operation of the system is made ready thereby.

The foregoing procedure relates to the washing of the system, when the water content of the powders in the hopper is above the limit water content.

When only centrifugal film drier 1 is washed separately, valve 10 is closed, and washing water is introduced to the drier through pipings 23, 24 to fill it in drier 1. Then, the rotor is rotated to improve the washing effect. The washing water is discharged to washing sump 8 through piping 17. Piping 17 is elevated to a level over valve 10, and discharge is carried out by utilizing a siphon effect after the washing. This is to prevent wetting of the route valve 10, hopper 2, valves 11, 12, and pipings 16, 29 and the resulting requirement for drying, if such route is employed to discharge the washing water from the drier.

As the kind of valve 10 at the outlet of centrifugal film drier, valve 11 at the outlet of hopper, and three-way switch valve 12 used in the foregoing system, ball valves are structurally most suitable in view of handling both powders and water.

According to the present method and apparatus, powders failing to satisfy the predetermined water content can be readily eliminated from the system, resulting in easy maintenance of a facility for treating radioactive wastes.

What is claimed is:

1. A method for treating aqueous solutions and suspensions of radioactive waste containing sodium sulfate, which comprises heating and drying the aqueous solutions and suspensions of radioactive waste in a drier thereby obtaining radioactive waste powders; transfering the powders from the drier to a hopper; measuring a water content of the powders retained in said hopper; when the measured water content satisfies a predetermined condition, transfering the powders from the hopper to a pelletizer; and pelletizing the powders therein; or when the measured water content of the powders fails to satisfy the predetermined condition, introducing a washing solution comprising hot water under pressure to the bottom of the hopper, thereby causing a stirring action between the washing solution and the powders and forming an admixture of an aqueous solution of the powders and an aqueous slurry of the powders; then discharging the washing solution and the radioactive waste powders from the hopper in the form of the admixture of the aqueous solution of the powders and the aqueous slurry of the powders; and thereafter drying the inside of the hopper whereby the hopper is made ready for storage of another batch of radioactive waste powders.

2. A method according to claim 1, wherein hot water at 32° C. or higher is used as the washing solution, when solid matters of the aqueous solutions and suspensions of radioactive waste are comprised mainly of $Na_2SO_4$.

3. A method according to claim 2, wherein the hot water is introduced to the hopper at the bottom from a washing tank by a pump, and recycling of the hot water is carried out through the pump, the hopper, the washing tank, and said pump.

4. A method according to claim 2, wherein the hopper is located below said drier and wherein the hot water is introduced up through the hopper to the inside of the drier to wash the hopper and the drier simultaneously, and then the resulting washing solution and powders are discharged therefrom.

5. A method according to claim 1, wherein the washing solution is introduced to the hopper at the bottom from a washing tank by a pump, and recycling of the washing solution during a washing operation is carried out through the pump, the hopper, the washing tank, and said pump.

6. A method according to claim 1, wherein the hopper is located below said drier and wherein the washing solution is introduced up through the hopper to the inside of the drier to wash the hopper and the drier simultaneously, and then the resulting washing solution and powders are discharged therefrom.

7. A method according to claim 6, wherein the washing solution is introduced into the hopper and drier and allowed to partially fill the hopper during dissolution and washing to form said admixture and thereafter the resulting admixture is discharged from the hopper.

8. A method according to claim 1 further comprising the step of introducing a gas into the bottom of the hopper together with said washing solution to promote dissolution and washing of the powders within said hopper by increasing the stirring action.

9. A method according to claim 8 wherein the gas introduced into the bottom of the hopper is compressed air.

10. A method according to claim 1 further comprising transfering the washing solution and the powders discharged from the hopper to the washing sump and thereafter recycling the resulting washing solution containing the powders to an inlet of the drier for retreatment therein said predetermined condition being satisfied when the powders have a water content below a definite limit content of a few percent.

11. A method according to claim 1 wherein drying the inside of the hopper is effected by introducing a dry gas into said hopper.

12. A method according to claim 11 wherein the dry gas introduced into the hopper is compressed air.

13. A method according to claim 1 wherein the washing solution and the radioactive powders are discharged from the top of said hopper and then passed to a washing tank and the resultant solution is recycled to the hopper for a predetermined period of time to complete the washing operation and thereafter the final resulting washing solution is discharged to a washing sump.

14. A method according to claim 1 wherein said radioactive waste is comprised mainly of $Na_2SO_4$ and said washing solution is hot water at a temperature of at least 60° C. whereby said powders are converted into a slurry state without the formation of crystals of $Na_2SO_4$.

15. An apparatus for treating aqueous solutions and suspensions of radioactive waste which comprises a drier for evaporating and drying solutions and suspensions of radioactive waste to provide radioactive waste powders, a closed hopper connected to said dryer for receiving the powders therefrom and for storing a batch of powders therein, a pelletizer means for pelletizing the powders contained within said hopper, said pelletizer means being located downstream of said hopper and connected to said hopper via conduit means, means for measuring a water content of the batch of powders to determine whether the water content of the powders within the hopper satisfies a predetermined condition, means for transfering the powders from the hopper to said pelletizer means via said conduit means when the powders satisfy said predetermined condition, means for supplying a washing solution under pressure into the bottom of said hopper when the measured water content of the powders fails to satisfy said predetermined condition thereby causing a stirring action between the washing solution and the powders and forming an admixture of an aqueous solution of the powders and an aqueous slurry of the powders within said hopper, means for discharging the admixture containing the washing solution and the powders from the hopper, and means for introducing a drying gas into the inside of the hopper after discharge of the admixture containing the washing solution and said powders, whereby the inside of the hopper is dried and made ready for the storage of another batch of dried radioactive waste powders.

16. An apparatus according to claim 15 wherein said means for discharging the washing solution and the powder from said hopper is connected to a washing sump for receiving said washing solution and said powders and means for recycling the washing solution and powders to an inlet of the drier for retreatment therein.

* * * * *